US009604117B2

(12) United States Patent
Leonard

(10) Patent No.: US 9,604,117 B2
(45) **Date of Patent: *Mar. 28, 2017**

(54) GOLF STROKE TRAINING DEVICE

(71) Applicant: Schalk J. Leonard, Poulsbo, WA (US)

(72) Inventor: Schalk J. Leonard, Poulsbo, WA (US)

( * ) Notice: Subject to any disclaimer, the term of this patent is extended or adjusted under 35 U.S.C. 154(b) by 169 days.

This patent is subject to a terminal disclaimer.

(21) Appl. No.: 14/706,011

(22) Filed: May 7, 2015

(65) Prior Publication Data

US 2015/0231476 A1 Aug. 20, 2015

Related U.S. Application Data

(63) Continuation of application No. 12/592,227, filed on Nov. 20, 2009, now Pat. No. 9,044,661.

(60) Provisional application No. 61/268,729, filed on Jun. 15, 2009.

(51) Int. Cl.
*A63B 69/36* (2006.01)

(52) U.S. Cl.
CPC ..... *A63B 69/36* (2013.01); *A63B 2220/805* (2013.01)

(58) Field of Classification Search
None
See application file for complete search history.

(56) References Cited

U.S. PATENT DOCUMENTS

| | | | | |
|---|---|---|---|---|
| 4,180,270 | A | 12/1979 | Long | |
| 4,304,406 | A | 12/1981 | Cromarty | |
| 4,615,526 | A | 10/1986 | Yasuda et al. | |
| 5,108,105 | A | 4/1992 | Shimizu | |
| 5,472,205 | A * | 12/1995 | Bouton | A63B 69/3614 473/222 |
| 5,614,823 | A | 3/1997 | Katayama | |
| 5,685,782 | A | 11/1997 | Lipps et al. | |
| 5,788,583 | A * | 8/1998 | Agulnek | A63B 69/3676 473/225 |
| 5,826,874 | A * | 10/1998 | Teitell | A63B 69/3614 473/225 |
| 6,146,283 | A | 11/2000 | Ferguson, III | |
| 6,254,492 | B1 * | 7/2001 | Taggett | A63B 24/0003 434/252 |
| 7,297,069 | B2 | 11/2007 | Donovan et al. | |
| 7,329,193 | B2 | 2/2008 | Plank, Jr. | |
| 7,744,482 | B1 | 6/2010 | Watson | |
| 7,850,536 | B1 | 12/2010 | Fitzgerald | |
| 2006/0252567 | A1 * | 11/2006 | Donovan | A63B 69/3676 473/173 |
| 2008/0102970 | A1 * | 5/2008 | Park | A63B 24/0003 473/180 |
| 2010/0087266 | A1 | 4/2010 | Nicodem et al. | |

* cited by examiner

*Primary Examiner* — Tramar Harper

(57) ABSTRACT

A golf stroke training device and system allowing a user to obtain feedback regarding a golf stroke without moving from a stance and capable of detecting the orientation and velocity of a leading edge of a golf club. A data processing unit filters out non-relevant inputs from the sensors and only evaluates valid simulated forward strokes so that the data processing unit may evaluate a plurality of non-stop practice strokes.

20 Claims, 2 Drawing Sheets

GOLF STROKE TRAINING DEVICE

PRIORITY CLAIM

This application is a continuation of U.S. application Ser. No. 12/592,227, filed Nov. 20, 2009, which claims the benefit of priority to U.S. patent application Ser. No. 61/268,729 filed on Jun. 15, 2009, the contents of which are herein incorporated by reference in their entirety.

TECHNICAL FIELD OF THE INVENTION

This invention relates to devices to assist golfers in improving their putting performance.

BACKGROUND

The game of golf can be regarded as having two distinct phases: the first phase begins when the golfer "tees off" by making an initial stroke of the ball, lofting the ball into the air, and then may follow up with additional strokes of the ball which loft the ball into the air, with the goal of landing the ball on a manicured grassy surface known as the "green." Once the ball is on the "green," the golfer uses a special club known as a "putter" to strike the ball and cause it to roll toward, and ideally into, a hole in the ground called the "cup." The putting stroke, unlike the previous strokes off of the green, involves causing the ball to roll with no perceptible vertical lift off of the surface of the ground.

Most golfers are aware of an idiom to the effect that one "drives for show and putts for dough." This means that, while the initial strokes of the ball may be satisfying from the standpoint of covering long distances, the key factor that determines whether one achieves a winning or satisfactory score in the game of golf is whether one can regularly putt the ball into the cup from a variety of distances with a minimum numbers of strokes. Often victory in a game of golf will be decided by the ability to make a single putt.

Typically, a putt will involve striking the ball with a putter club and causing the ball to roll anywhere from a few inches to upwards of 100 feet to reach the cup. The farther the ball is sitting stationary from the cup at the time the putting stroke is executed, the more difficult it becomes to accurately cause the ball to roll into the cup on a single stroke.

Competitive golfers may spend many hours practicing their putting stroke. Typically, they will assemble a large number of balls on a practice putting green, and will then proceed to strike one ball, watch it roll toward the cup, and when it stops, they will assess what they have just done, and will then proceed to execute a second stroke following a similar sequence. In doing so, they will attempt to recall from "muscle memory" the precise kinesthetically-recalled executions of the previous stroke and make corrections based on the results of the previous stroke.

A variety of mechanical devices have been invented to assist golfers in executing a proper golf putting stroke. These devices include tracks and ramps that assist the golfer in drawing back the club and then returning the club to strike the ball along a predetermined plane and arc, and laser and other optical devices which attach to the club and which point from the clubhead to the distant cup thereby enabling the golfer to see the line which the ball should roll along.

In addition, computer-based devices have been invented to assist golfers in recording and analyzing their golf swing, using both the putter and other clubs. These devices use graphic displays which are set up in the vicinity of the location of the putting training event and require the golfer to execute a stroke and then look up, divert the attention, study a graphic display, and then execute a second stroke with the intent of correcting any deviations identified in the previous stroke.

The drawback to the mechanical devices which train one how to swing the club back and to return it along a predetermined plane and arc is that every golfer has a different body type and the uniqueness of each body dictates that each golfer will have a different ideal swing which feels and works best. In addition, the success or failure of a golf putting stroke is not determined by the events prior to making contact with the ball, but is solely a function of the velocity and angle of the golf putter head at the moment of impact with the ball.

The drawback to the laser device and other devices which attempt to show the proper line of a putt is that these devices cannot provide meaningful information concerning the velocity required to execute a successful stroke and, regarding the angle of the club head, the differences between a successful and an unsuccessful putt are a function of very minute variations in the angle of the club head face which even the best human eye cannot discern. Moreover, one must wait for the ball to roll to the target cup to know whether the stroke was successful and this involves a waiting period during which muscle memory is rapidly being lost or degraded.

Precise human muscle memory is very quickly degraded. Any device which requires that one execute a single stroke and then stop, look up, avert one's gaze, study a graphic display, read numbers and analyze data and diagrams, and then return for a second practice stroke is depriving the golfer of the ability to execute a multiplicity of strokes in quick rhythmic succession, hold an event in muscle memory, and to get meaningful feedback and make precise corrections after each stroke. Put plainly, no device exists which provides precise and immediate visual and audio feedback on clubhead velocity and angle at the moment of arrival at the "target zone" such that one can repeatedly practice in a non-stop rhythmic manner without moving out of the putting position and without moving one's head and get into a "groove" of successful muscle memory performance. Perfect practice "makes perfect" and the more times one practices perfectly, the more likely it becomes that one will be able to execute a similarly perfect putt in an actual "real-world" putting situation.

There is a need for a golf putting stroke training device which will assist a golfer to develop a controllable and repetitive putting stroke, and to adapt that stroke to different putting distances and conditions. The Golf Putting Stroke Training Device of the present invention (hereinafter the "trainer") addresses this need.

The trainer permits the golfer to practice a putting stroke in a non-stop, rhythmic manner and get into a "groove" of successful muscle memory performance by providing virtually instantaneous visual and/or audio signals which inform the golfer whether a given putting stroke would have caused a standard golf ball, rolling on a flat surface of pre-selected rolling resistance, to successfully "drop" into the target cup; and if the practice putting stroke would be unsuccessful, whether the putt would be a near miss or a more off-target putt, and whether the unsuccessful putt would have been too short, too long (i.e., stroked with too high velocity), and/or deviated to the left or right of the target cup.

The trainer of the present invention permits the golfer to see, without raising his body or head or averting his gaze farther than a few feet from the ball position, visual indication on the device in the form of lights or other visual evidence whether a ball would have rolled along a proper line and into a cup, along a proper line but not far enough to reach the cup, along an improper line but stopping close enough to constitute a "near miss," or along an improper line and stopping beyond what has been predetermined to be a "near miss" distance, and to see different visual signals (for example, using different colored lights set out in concentric arrays) indicating the outcome of each putting stroke.

The trainer also allows the golfer to select the distance of the putt he or she wishes to perfect their putting stroke for. It also allows the golfer to select whether audible signals are to be provided and the volume of such audible signals. Additional display means for "score-keeping" may also be provided The rolling resistance encountered by a putted golf ball rolling on a golf green will vary depending on such factors as the height of the grass, and it's moisture level. As a result, a golf ball putted with a given velocity will travel different distances, depending on the condition of the green it is on. This variation in rolling resistance, often referred to as the "speed" of a green, may be quantitatively described and specified as a "Stimp level". The Stimp level of a green is empirically determined by the Stimpmeter, which is an angled track that releases a ball at a known velocity so that the distance it rolls on a green's surface can be measured. The distance in feet traveled by a ball released at a velocity of 6 ft/sec is the Stimp level of the green. Stimp levels may vary from about 4.5 to 8.5 for average greens, to 13 or more for exceptionally fast greens.

The trainer of the present invention also allows the golfer to select the speed or Stimp level he or she wishes to perfect their putting stroke for.

OBJECTIVES AND SUMMARY OF INVENTION

It is an objective of the present invention to provide a device to assist a golfer in improving his or her putting stroke.

It is a further objective of the present invention to provide such a device which provides near-instantaneous feedback to the golfer as to whether a given practice putt was successful (i.e. the velocity and angle of the putter club met the required parameters such that the stroke would have caused a real ball to travel on a flat surface into a golf cup had a ball been struck) or not.

It is a further objective of the present invention to provide such a device which provides a read-out display on the face of the device which permits a golfer to see, without looking up or away, whether a practice putt has been successful.

It is a further objective of the present invention to provide, in an alternate embodiment, such a device which provides audio signals emanating from the device which permit a golfer to hear whether a practice putt has been successful.

It is a further objective of the present invention to provide such a device which allows a golfer to use a putter of his or her choice, without any additional apparatus or encumbrance attached thereto, and operate or stroke said putter as he or she would in an actual golf game.

It is a further objective of the present invention to provide such a device which allows the golfer to select putting conditions, such as distance to cup and golf green speed (Stimp level).

It is a further objective of the present invention to provide such a device which is compact and self-contained, and easily transportable, and which can be removed from its carrying case, plugged into an electrical outlet (or switched on, in alternative battery-powered embodiments) and be ready for use within a matter of seconds.

The trainer of the present invention accomplishes these objectives by providing a device comprising: means to determine the velocity and angular orientation of a putter operated by a user as it strikes a simulated golf-ball; data processing means to determine the path and distance said golf-ball would travel, and determine if said path and distance would result in a successful putt or a missed putt; and means to display the results (i.e., a successful or a missed putt) virtually instantaneously.

DETAILED DESCRIPTION OF THE INVENTION

Figure 1:
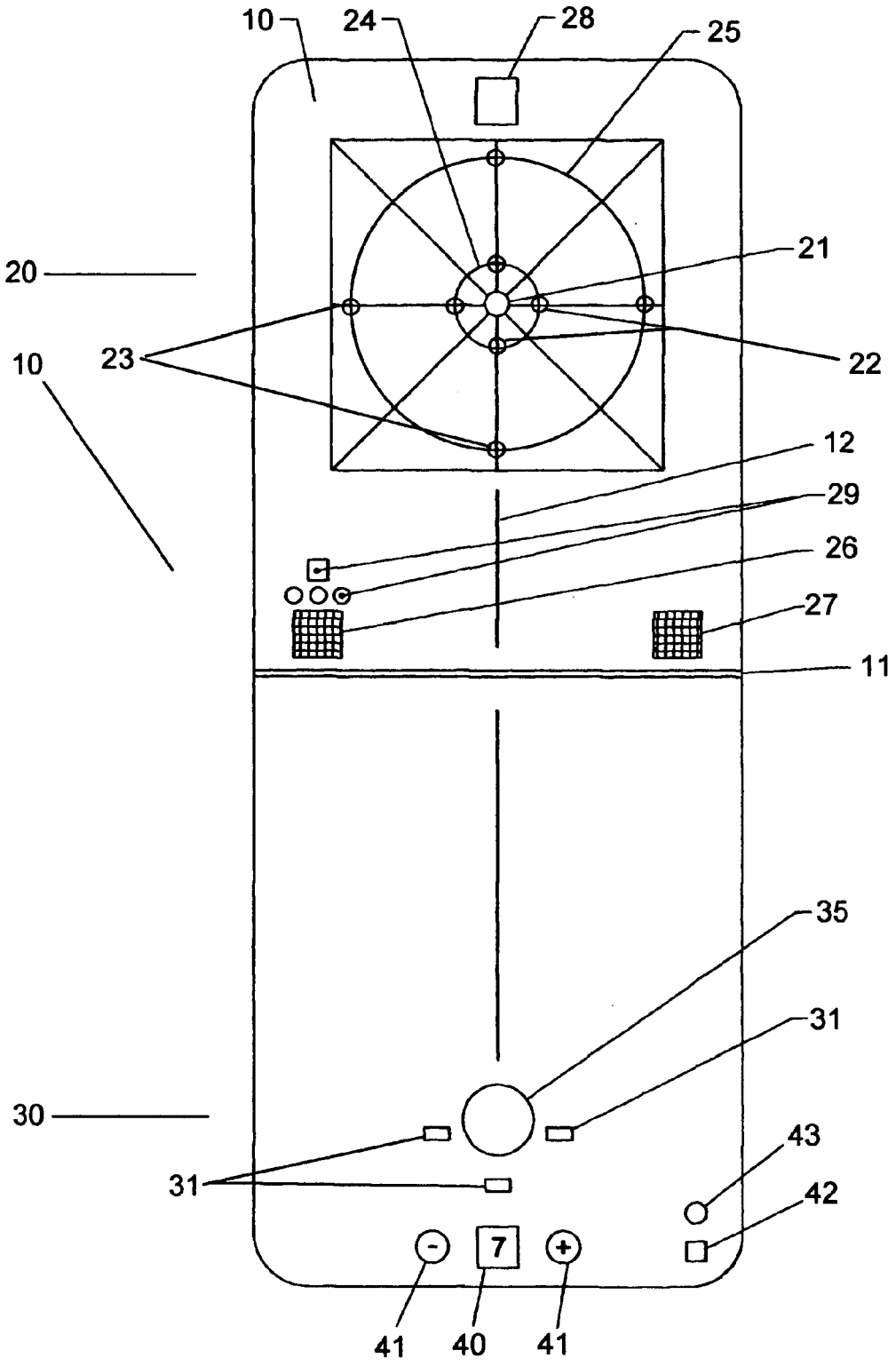
FIG. 1 shows a top view of a preferred embodiment of the trainer of the present invention.

The trainer of the present invention, illustrated at 10 in FIG. 1, is used by person operating a putter of his or her choice in a practice stroke, as if making a putt, and comprises a putting stroke measuring and analyzing component and a display component.

The measuring and analyzing component determines the putter club head angular orientation and velocity for a simulated putt, and computes the trajectory and range which an actual golf ball located on the analyzing component would take if struck with the putt analyzed. The measuring and analyzing component also determines whether the stroke analyzed would have propelled an actual golf ball:

- "on target"—i.e. an actual golf ball would drop into a target cup;
- "short"—i.e. not go far enough to reach the target cup;
- "long"—i.e. with a velocity sufficient to cause an actual golf ball to skip over the target cup;
- "left" or "right"—i.e. deviating to the left or right of the target.

The display component indicates to the user whether the stroke analyzed would have propelled a golf ball on target, long or short, and/or right or left.

Trajectory shall be used herein to denote the angle, with respect to a reference axis, of the path a golf ball would take if struck with the stroke being analyzed; range shall denote the distance a golf ball would travel if so struck. As used herein the reference axis will be the axis of the trainer extending from simulated golf ball location 35 to display target 21, both of which will be described below, and will include the extension of said axis in "virtual space". Said axis is designated as 12 in FIGS. 1 and 2. Left and right will be used herein to designate right and left for a user facing display target 21 from simulated golf ball location 35. Short will be used herein to refer to the direction toward simulated golf ball location 35 from display target 21, and long will be used herein to refer to the opposite direction from display target 21. The terms axial and lateral will be used herein to refer to directions along and transverse, respectively, to trainer axis 12.

The display component provides virtually instant feedback to the user as to whether a simulated practice putt is "good"—i.e, on target—or a miss short, long, left or right. This instant feedback is believed to facilitate the development of "muscle memory" for the user, and the development of a sense and "feel" for accurately and sensitively controlling the putt stroke.

A preferred embodiment of the trainer is illustrated in FIG. 1. Trainer 10 is comprised of display component 20 (hereinafter the "display"), and measuring and analyzing component 30 (hereinafter the "analyzer"). Both components are enclosed in a housing with a substantially flat upper surface, and of size selected to allow the user to see the display while concentrating on his or her stroke in the analyzer.

Said housing may preferably comprise hinge 11, to allow the trainer to be folded into a more compact form for ease of transport and storage. Preferably the device will be small enough to fit into a laptop computer bag such that it can be easily carried on an airplane or while walking.

Analyzer 30 will comprise a data processing unit (hereinafter the "DPU"), preferably a digital computer, comprised within the analyzer and means operatively coupled thereto to determine the velocity of a simulated putting stroke, and to determine the trajectory and range of a putt which would result from said simulated putting stroke. Said DPU will comprise a timer functionality, such as is well known in the art.

Figure 2:
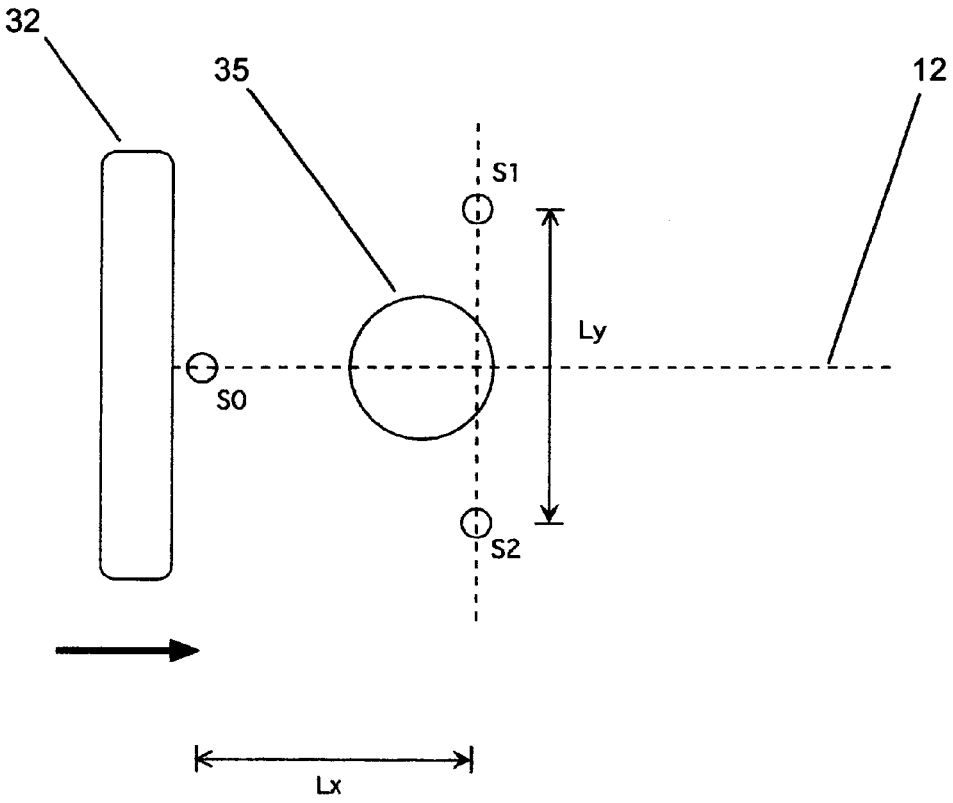
FIG. 2 is a diagram illustrating details of the photodetector array which determines club-head velocity and angular orientation.

In a preferred embodiment, shown in FIG. 1 and illustrated diagrammatically in more detail in FIG. 2, analyzer 30 comprises an array of at least three sensors or detectors, $S_0$, $S_1$ and $S_2$, shown at 31 in FIG. 1, arranged in a triangular array abutting simulated golf ball location 35. Said sensors detect the presence of a putter club head passing over them. Sensors $S_0$, $S_1$ and $S_2$ may preferably be retroreflector photosensors such as Omron model E3T-SL21, or any sensor with a relatively narrow region (cone) of sensitivity. Selection of an appropriate sensor will be readily determined by one skilled in the art. Sensor $S_0$ is preferably located on trainer axis 12, and sensors $S_1$ and $S_2$ are located on an axis approximately perpendicular to the axis 12. The sensors will detect the presence of putter 32 as it passes over them in a practice putting stroke. Analyzer 30 also comprises the location of a simulated golf-ball 35, which may preferably comprise a white circle of a diameter approximately the same as a standard golf ball. Signals from sensors $S_0$, $S_1$ and $S_2$ are received by the DPU.

Sensors will preferably have the following capabilities: time resolution equal to or faster than approximately 200 microseconds; spatial resolution equal to or less than 0.3 millimeters; time and spatial resolutions that do not vary when the club head arrives between approximately 5 and 50 millimeters above the surface of the device where the sensors are arrayed. Selection of appropriate sensors is within the purview of one skilled in the art.

When a user is preparing to make a simulated practice putt, making practice swings and aligning the putter, and when he/she makes the backswing, the sensors will detect the intermittent presence of the putter head. In said preferred embodiment the DPU may be programmed to filter out such relatively random and non-relevant detections, and to accept as a valid simulated putt only a stroke which is detected by said first sensor $S_0$, and then by sensors $S_1$ and $S_2$ within a predetermined short period of time.

The distance between $S_1$ and $S_2$ is chosen such that the club-head of most putters in common use will pass over both sensors in executing a simulated practice putt; if the head of the user's putter of choice is too short to bridge $S_1$ and $S_2$, a flat panel of metal or plastic, sufficiently long to bridge said sensors may be detachably attached to the bottom of the head of said putter.

In said preferred embodiment, analyzer 30 determines the simulated range and trajectory which an actual golf ball, located at location 35, would take if struck by the chosen putter operated by the user as in a practice stroke. No actual golf ball is struck; location 35 merely indicates where a simulated target golf ball would be.

The simulated range is determined from the measured velocity v of the user's putting stroke. If $t_0$, $t_1$ and $t_2$ are the times putter 32 is detected by $S_0$, $S_1$ and $S_2$, respectfully, and if Lx is the distance from $S_0$ to the $S_1$-$S_2$ axis, as illustrated in FIG. 2, the velocity will be computed by $$\frac{1}{v} = \frac{t_1 + t_2 - 2t_0}{2Lx}$$

The range of a golf ball struck with a putter at velocity v is determined empirically. A pendulum-mounted putter-head simulator, which can be displaced by varying angular deviations from the vertical, is caused to strike a golf ball with varying velocities, the velocities being measured by a sensor array and DPU similar to the array and DPU of analyzer 30. The distance traveled by a golf ball so struck over a flat "synthetic putting green" carpet is measured for a number of velocities. The DPU is programmed to calculate the simulated range of any practice stroke from the measured putter-head velocity of said stroke by intrapolation or extrapolation from such measured range vs. velocity values. Such programming is well within the purview of one skilled in the art.

The trajectory resulting from a practice stroke (with reference to axis 12) is also calculated by the DPU from $t_0$, $t_1$ and $t_2$, the times putter 32 is detected by sensors $S_0$, $S_1$ and $S_2$, respectfully, as follows:

$$\theta = \tan^{-1}\frac{[r(t_2 - t_1)]}{L_y}$$

where θ is the angle between the path of a simulated practice putt and axis 12 and $L_y$ is the distance, perpendicular to axis 12, between sensors $S_1$ and $S_2$. It is assumed that the trajectory of a simulated practice putt will be perpendicular to the putter head.

The DPU will also determine, from the range and trajectory determined as described hereinabove, whether a given simulated practice putt will be "good"—i.e. had a real golf ball been struck, it would have rolled and dropped into a cup located a specified distance from the ball initial position—or would be a "miss".

The simulated target will be located a simulated distance from simulated golf-ball position 35 selected by the golfer, herein designated $R_0$. The trainer will comprise a switch or similar selection means, operatively connected to the DPU, to permit selection of the desired $R_0$. The trainer may also preferably comprise display means, operatively connected to the DPU, which show the golfer the value of $R_0$ selected. Said selection means are indicated as 41, and said display means as 40, in FIG. 1.

The simulated target may be considered a geometric point located on an extension of axis 12 a simulated distance $R_0$ from simulated golf ball position 35. The location of the display target on the display component, shown as 21 in FIG. 1, may preferably be closer to position 35, more preferably sufficiently close that a user, concentrating his or her attention on the putter head and simulated golf ball position 35 will also be able to observe the display target and surroundings in his or her peripheral vision. Preferably, the portion of axis 12 from simulated golf ball position 35 to display target 21 may be prominently marked on the surface of trainer 10, as by a stripe of contrasting color or similar means.

A standard golf cup is 4¼" in diameter, but a putted golf-ball may "rim" the cup, and fail to drop in, if it passes too close to the edge or rim of the cup. The acceptable (as good) deviation of a simulated putt's trajectory from "dead on" the target (i.e. on axis 12 at $R_0$) can be varied within the DPU program, but may preferably be set to be 1½". That is, the DPU may preferably be programmed to count a simulated putt as "good" if the trajectory of the putt, at the selected putt distance, would be within 1½" of the simulated target, and if the range of the simulated putt is sufficient to reach the target.

In actual putting, a putt at a trajectory properly aimed at the cup will drop in the cup as long as it has sufficient velocity to reach the cup, but not such excess velocity as to cause it to skip over the cup without dropping in. In a preferred embodiment of the trainer, if the range of a simulated putt, with a trajectory which would pass within ±1½" of the target at a range of $R_0$, is such that it would go past the target by less than a selected amount AR, it is assumed the simulated putt would "drop", or be good. The value of AR can be adjusted within the DPU program; but is preferably set to vary from about 1 foot for a simulated putt of 5 feet to about 2 feet for a simulated putt of 10 feet, proportionally adjusted for other values of $R_0$. Thus if a simulated putt with an on-target trajectory is between 1½" "short" (i.e. less than the target distance) and "long" (i.e. a value greater than the target distance) by ΔR, it will be counted as good.

Thus, in a preferred embodiment of the trainer, the conditions for a simulated putt to be designated good, which are established by suitable programming of the DPU, are: a trajectory within ±1½" of axis 12 at $R_0$, and a range between $R_0$-1½" and $R_0$+ΔR, where ΔR may be set to any desired value, but in a more preferable embodiment, is 12" for $R_0$=5' and 24" for $R_0$=10', proportionally adjusted for other values of $R_0$. Suitable programming techniques, such as calculating the distance from the target point to the simulated trajectory at range $R_0$ or other methods are well known to one skilled in the art.

It will be useful in further describing the invention of the present patent application to define a "good-putt zone" and a "near-miss zone". Said zones are not physical areas, but loci of points in the virtual space of said DPU which meet defined criteria. If the end point of a simulated practice putt—i.e., the point at the end of the range at the trajectory determined by said DPU, determined as described hereinabove—is within the criteria of the immediately preceeding paragraph, said putt will be within the good put zone. A simulated practice putt deviating from said simulated target by more than the criteria specified for the good-putt zone, but less than other specified deviations will be in a near-miss zone.

Thus, in a preferred embodiment, the good-putt zone is defined as an end point of a simulated putt with a trajectory within ±1½" of axis 12 at $R_0$, and a range between $R_0$-1½" and $R_0$+ΔR, where ΔR may be set to any desired value, but in a more preferable embodiment, is 12" for $R_0$=5' and 24" for $R_0$=10', proportionally adjusted for other values of $R_0$.

In said preferred embodiment, the DPU is programmed to determine if a simulated practice putt outside the good-putt zone would be a "near miss" or would miss or overshoot the target by a greater amount—i.e, be "no good". While the criteria for said near miss designation are arbitrary, in a more preferred embodiment a simulated putt will be designated a near miss that is, would be in said near-miss zone—if its trajectory will be between 1½" and 7½" from axis 12 at $R_0$, and/or it's range will be between 1½" and 7½" short, or between 12" and 19½" long for $R_0$=5', or between 1½" and 7½" short, or between 24" and 31½" long for $R_0$=10'. In said more preferred embodiment, the tolerance for a near-miss in the long direction will be proportionally adjusted for other values of $R_0$.

In said preferred embodiment, said DPU will also distinguish between simulated practice putts outside the good-putt zone and the near-miss zone which deviate from said zone to the left or right of axis 12, or in the short or long direction.

The display component will comprise audible and/or visual means to inform the user if a simulated putt is in the good-putt zone, short, long or off-course to the left or right, or if it is in said near-miss zone or a clear miss or no-good effort.

In a preferred embodiment, the display will comprise a simulated target, located on trainer axis 12 and shown as 21 in FIG. 1, comprising a visible-light emitter such as an incandescent lamp, a LED or similar light emitter, which preferably lights up when a simulated putt is determined by the DPU to be in the good-putt zone. The display of the preferred embodiment also comprises an array of near-miss emitters 22, one each located to the left and right of the simulated target, one located in the long direction, beyond the simulated target and one located short of said target; said emitters will signal a near-miss in the left, right long or short direction, respectively. All said light emitters are operatively connected to the DPU. The DPU will cause the near-miss light corresponding to the direction by which the near-miss putt misses the target to light up or flash for a brief period. In the display of the preferred embodiment, a plurality of light emitters may be flashed at the same time; thus, a simulated practice putt that is determined by the DPU to be both short and off-course to the left will cause both near-miss-short and near-miss-left emitters to light up.

Said preferred embodiment will also comprise an array of light emitters indicating a simulated practice putt is determined by the DPU to be outside the near-miss zone. Said no-good emitters, shown as 23 in FIG. 1, are similarly disposed in short, long and left and right directions with respect to target 21, to signal the direction of the miss. Said array of no-good indicating light emitters will preferably be located outside the array of near-miss emitters, as shown in FIG. 1.

In said preferred embodiment, each of the near-miss and no-good light emitters will light up in a different color, and a different color than the on-target emitter. In a more preferred embodiment, said on-target emitter will light up green, said near-miss emitters will light up blue, and said no-good emitters will light up red.

In a more preferred embodiment, the upper surface of the trainer will comprise two circles, concentric to said simulated target emitter, imprinted on the surface. Near-miss emitters will be located on the smaller of such circle, shown at 24 in FIG. 1, and no-good emitters will be located on the larger of such circle, similarly shown as 25. This arrangement is illustrated in FIG. 1. Said more preferred embodiment will also comprise visual marking of trainer axis 12.

The on-target, near-miss and no-good emitters will provide near instantaneous feedback to the user of the success or failure of his/her simulated putt, and an indication of what corrective action should be taken.

A more preferred embodiment of the trainer display may comprise additional components to enhance the instantaneous feedback, such as a compact loudspeaker 26, operatively connected to the DPU, which may emit sounds such as a "click" at the instant the putter would contact a simulated golf ball at 35 and a different sound to simulate the dropping of a successful putt into the cup. Different sounds may be produced to signify a near-miss and/or a no-good effort. Such sounds may be computer-generated by the DPU, or pre-recorded and input via microphone 27 to be stored as sound files in the DPU.

A more preferred embodiment of the trainer display may also comprise a numerical display 28, operatively connected to the DPU, which may display information such as the number of consecutive on-target simulated putts, the number of on-target putts in a practice session, the total number of simulated putts in the practice session, or similar numerical "score-keeping" information. Controls 29 may be provided in said preferred embodiment to reset counters providing numerical display 28, activate microphone 27, and adjust the volume of the audible signals emitted by loudspeaker 26.

A more preferred embodiment of the trainer display may also comprise means to select the desired distance of the simulated practice putt, from simulated ball position 35 to simulated target 21. Said selection means are indicated as 41, and said display means as 40.

A more preferred embodiment of the trainer display may also comprise a switch or similar selection means, operatively connected to the DPU, to allow the user to adjust the green speed or Stimp value he or she wishes to practice for. Such switch or similar selection means is illustrated at 43 in FIG. 1; said more preferred embodiment may also comprise a display, shown at 42 in FIG. 1, which displays the Stimp level selected.

The selected Stimp level will be utilized by the DPU to adjust the simulated range resulting from of a simulated putt, by programming techniques well known to those skilled in the art.

Electrical power for the trainer of the present invention may be provided by an electric cord comprising a suitable plug to operatively connect to a conventional 110 VAC outlet, and providing electric power to a suitable transformer and rectifier; selection of transformer and rectifier will be readily apparent to one skilled in the art. In an alternative embodiment, electric power may be supplied by batteries comprised in the trainer. Preferably, electric power for the trainer will be provided by rechargeable batteries, which batteries may be recharged by connecting a suitable power cord to a conventional 110 VAC supply. Implementation of such electric power supply means will be readily apparent to one skilled in the art.

The trainer of the present invention is not designed to exactly duplicate an actual putt, but to establish a simulated putting situation similar enough to a "real-world" putt that the putting skill and facility acquired by use of the trainer will be transferable to "real world" putting situations. Diligent use of the trainer will condition the user's neuromuscular system to consistently and precisely control his or her putting stroke, which will enhance the user's ability to adjust that stroke to real-world putting challenges.

A principal advantage of the golf putting trainer of the present invention is that it is compact and easily transportable, and may be quickly and easily set up for use—by simply placing the device on the floor or ground and switching it on, after connecting it's power cord to an outlet, if necessary. No other equipment, except for the user's putter, is needed.

A further principle advantage is the near-instantaneous feedback to the user as to whether a simulated practice putt was good, a near-miss, or no good—a clear miss, Such feedback will further indicate whether a miss is long, short, or left or right of the target. A user may concentrate his or her attention on the putter and simulated golf-ball location 35, and observe the display in peripheral vision, and may quickly correct direction or club speed, repeat the stroke and observe the result. A stroke may be repeated every few seconds, to "get it right", then to "lock in" the successful stroke in muscle memory.

While the golf putting trainer of the present invention was designed for use in putting, it will be apparent that the device may be used to improve the stroke with other golf clubs, particular clubs designed for short-range shots such as chip shots. In certain situations in a game of golf, golfers are presented with shots which are near to but not on the green. Such shots are known as chip shots. In most cases, golfers will opt to use a pitching wedge, a sand wedge, or a short iron club rather than a putter to execute a chip shot. The chip shot allows the golfer to cause the ball to leave the surface of the ground during its initial flight ("loft") and to then land on the green and begin its roll toward the cup. Accuracy (trajectory and range control) and precision (repeatability) of stroke are very important for such shots, and embodiments of the present invention would be useful in improving a golfer's skill in such "short game" strokes. Users of the golf putting trainer of the present invention may choose to practice short chip shot motions on the device, thereby gaining immediate feedback on the clubhead angle alignment at the moment of impact. Distance feedback will, of course, not be as accurate given the factor of loft in an actual chip shot. Golfers may also choose to practice other low-speed strokes with all other golf clubs over the device to gain neuromuscular memory on proper club head angle.

Other embodiments will be apparent to one skilled in the art, which will change various details of the present invention without limiting its scope. Furthermore, the foregoing description of the preferred embodiment of the invention and the best mode for practicing the invention are provided for the purpose of illustration only and not for the purpose of limitation of the invention, which will be defined by the claims appended hereto.

The invention claimed is:

1. A golf stroke training device allowing a user to obtain feedback regarding a golf stroke without moving from a stance and capable of detecting the orientation and velocity of a leading edge of a golf club having a toe portion and a heel portion, comprising:

(a) a housing having a simulated playing surface;

(b) a visual indicator;

(c) an array of at least three sensors located within the housing, including at least a heel sensor (S1) and a toe sensor (S2) on an impact S1-S2 axis that is perpendicular to a target axis, wherein the heel sensor (S1) and the toe sensor (S2) are spaced apart and located on opposite sides of the target axis, and a velocity sensor (S0) distal to the impact S1-S2 axis; and (d) a data processing unit operatively coupled to the sensors (S0, S1, S2) and the visual indicator, wherein:

(1) the data processing unit calculates the orientation and velocity of the leading edge of the golf club at the impact S1-S2 axis during the forward movement of the golf stroke in response to input from the velocity sensor (S0), the heel sensor (S1) and the toe sensor (S2), wherein the velocity calculation takes into account a first time that the leading edge of the heel portion crosses the heel sensor (S1) and a second time that the leading edge of the toe portion crosses the toe sensor (S2);

(2) the data processing unit utilizes a target distance (R0) and the orientation and velocity of the leading edge of the golf club to:
  (i) determine a simulated shot range;
  (ii) determine if the simulated shot range is within a good shot range defined by the target distance (R0) minus an acceptable short distance;

(3) the data processing unit controls the visual indicator to inform the user whether target range is within the good shot range;

(4) the data processing unit utilizes the target distance (R0) and the orientation and velocity of the leading edge of the golf club to:
  (i) determine a simulated shot trajectory;
  (ii) determine if the simulated shot trajectory is within an acceptable trajectory offset distance from the target axis at the target distance (R0);

(5) the data processing unit controls the visual indicator to inform the user whether simulated shot trajectory is within an acceptable trajectory offset distance; and (6) the data processing unit filters out non-relevant inputs from the velocity sensor (S0), the heel sensor (S1), and the toe sensor (S2), and only evaluates valid simulated strokes detected first by the velocity sensor (S0) and then the heel sensor (S1) and the toe sensor (S2) so that the data processing unit may evaluate a plurality of non-stop rhythmic practice strokes.

2. The golf stroke training device of claim 1, wherein the visual indicator is oriented in a horizontal plane parallel with the housing.

3. The golf stroke training device of claim 1, wherein a simulated target is within the visual indicator.

4. The golf stroke training device of claim 1, wherein the visual indicator includes a short indicator that is activated by the data processing unit when the simulated shot range is less than the good shot range.

5. The golf stroke training device of claim 1, wherein the good shot range includes an acceptable overage distance (ΔR) and the visual indicator includes a long indicator that is activated by the data processing unit when the simulated shot range is greater than the good shot range.

6. The golf stroke training device of claim 5, further including a distance selection input device operatively coupled to the data processing unit, wherein the distance selection input device permits user input of the acceptable overage distance (ΔR).

7. The golf stroke training device of claim 5, further including a distance selection input device operatively coupled to the data processing unit, wherein the distance selection input device permits user adjustment of the acceptable overage distance (ΔR).

8. The golf stroke training device of claim 5, wherein the acceptable overage distance (ΔR) includes at least two acceptable overage distances (ΔR) that are dependent on the desired target distance (R0).

9. The golf stroke training device of claim 1, wherein the visual indicator includes a near-miss indicator that is activated by the data processing unit when the data processing unit determines that the simulated shot trajectory is within five times the acceptable trajectory offset distance from the target axis at the desired target distance (R0), but is not within the acceptable trajectory offset distance from the target axis at the desired target distance (R0).

10. The golf stroke training device of claim 1, wherein the velocity sensor (S0), the heel sensor (S1), and the toe sensor (S2) are arranged in a triangular array with the velocity optical sensor (S0) located on the target axis.

11. The golf stroke training device of claim 1, wherein the data processing unit controls the visual indicator to automatically inform the user of the number of consecutive strokes having the simulated shot range within the good shot range and the simulated shot trajectory within the acceptable trajectory offset distance, and the data processing unit resets the visual indicator to zero if a stroke does not have the simulated shot range within the good shot range and the simulated shot trajectory within the acceptable trajectory offset distance.

12. The golf stroke training device of claim 1, further including a distance selection input device operatively coupled to the data processing unit, wherein the distance selection input device permits the user to input the desired target distance (R0).

13. The golf stroke training device of claim 1, wherein the acceptable trajectory offset distance is user adjustable.

14. The golf stroke training device of claim 1, further including a simulated golf ball at the intersection of the impact S1-S2 axis and the target axis.

15. A golf stroke training device allowing a user to obtain feedback regarding a practice golf stroke without moving from a stance and capable of detecting the orientation and velocity of a leading edge of a golf club having a toe portion and a heel portion, comprising:

(a) a housing having a simulated playing surface;

(b) a visual indicator;

(c) an array of at least three sensors located within the housing, including at least a heel sensor (S1) and a toe sensor (S2) on an impact S1-S2 axis that is perpendicular to a target axis, wherein the heel sensor (S1) and the toe sensor (S2) are spaced apart and located on opposite sides of the target axis, and a velocity sensor (S0) distal to the impact S1-S2 axis;

(d) a distance selection input device permitting the user to input a desired target distance (R0); and (e) a data processing unit operatively coupled to the sensors (S0, S1, S2), the visual indicator (20), and the distance selection input device, wherein:
  (1) the data processing unit calculates the orientation and velocity of the leading edge of the golf club at the impact S1-S2 axis during the forward movement of the practice golf stroke in response to input from the velocity sensor (S0), the heel sensor (S1) and the toe sensor (S2), wherein the velocity calculation takes into account a first time that the leading edge of the heel portion crosses the heel sensor (S1) and a second time that the leading edge of the toe portion crosses the toe sensor (S2);
  (2) the data processing unit utilizes the target distance (R0) and the orientation and velocity of the leading edge of the golf club to:
    (i) determine a simulated shot range;
    (ii) determine if the simulated shot range is within a good shot range defined by a range from (A) the target distance (R0) minus an acceptable short distance, to (B) the target distance (R0) plus an acceptable overage distance (ΔR);
  (3) the data processing unit controls the visual indicator to inform the user whether simulated shot range is within the good shot range;

(4) the data processing unit utilizes the target distance (R0) and the orientation and velocity of the leading edge of the golf club to:

(i) determine a simulated shot trajectory;

(ii) determine if the simulated shot trajectory is within an acceptable trajectory offset distance from the target axis at the target distance (R0);

(5) the data processing unit controls the visual indicator to inform the user whether simulated shot trajectory is within an acceptable trajectory offset distance; and (6) the data processing unit filters out non-relevant inputs from the velocity sensor (S0), the heel sensor (S1), and the toe sensor (S2), and only evaluates valid simulated strokes detected first by the velocity sensor (S0) and then the heel sensor (S1) and the toe sensor (S2) so that the data processing unit may evaluate a plurality of non-stop rhythmic practice strokes.

16. The golf stroke training device of claim 15, wherein the visual indicator includes a short indicator that is activated by the data processing unit when the simulated shot range is less than the good shot range.

17. The golf stroke training device of claim 15, wherein the visual indicator includes a long indicator that is activated by the data processing unit when the simulated shot range is greater than the good shot range.

18. The golf stroke training device of claim 15, wherein the visual indicator includes a near-miss indicator that is activated by the data processing unit when the data processing unit determines that the simulated shot trajectory is within five times the acceptable trajectory offset distance from the target axis at the desired target distance (R0), but is not within the acceptable trajectory offset distance from the target axis at the desired target distance (R0).

19. The golf stroke training device of claim 15, wherein the data processing unit controls the visual indicator to automatically inform the user of the number of consecutive strokes having the simulated shot range within the good shot range and the simulated shot trajectory within the acceptable trajectory offset distance, and the data processing unit resets the visual indicator to zero if a stroke does not have the simulated shot range within the good shot range and the simulated shot trajectory within the acceptable trajectory offset distance.

20. The golf stroke training device of claim 15, wherein the distance selection input device permits user adjustment of the acceptable overage distance (ΔR).

* * * * *